United States Patent [19]

Ferrari et al.

[11] Patent Number: 4,811,980

[45] Date of Patent: Mar. 14, 1989

[54] COLLAPSIBLE BALL RETRIEVER AND STORAGE UNIT

[75] Inventors: Harry M. Ferrari; John M. Shallenberger, both of Pittsburgh, Pa.

[73] Assignee: Ball Hopper Products, Pittsburgh, Pa.

[21] Appl. No.: 207,677

[22] Filed: Jun. 16, 1988

[51] Int. Cl.[4] ..... A63B 47/02

[52] U.S. Cl. ..... 294/19.2

[58] Field of Search ..... 294/19.2, 15, 19.1; 273/32 F, 162 E, 162 F; 414/439, 440; 280/47.34, 47.35, 47.36; 248/129, 130, 132; 56/328 R

[56] References Cited

U.S. PATENT DOCUMENTS

| | | | |
|---|---|---|---|
| 704,848 | 7/1902 | Minton | 294/19.2 |
| 3,371,950 | 3/1968 | Stap | 294/15 |
| 3,820,836 | 6/1974 | Seewagen et al. | 294/19 A |
| 3,889,996 | 6/1975 | Campbell | 294/19 A |
| 3,984,138 | 10/1976 | Brunnek et al. | 294/19 A |
| 4,194,779 | 3/1980 | Ouhaswi | 294/19 A |
| 4,412,697 | 11/1983 | Vekde | 294/19 A |
| 4,461,504 | 7/1984 | Perez et al. | 294/19 A |

FOREIGN PATENT DOCUMENTS

| | | | |
|---|---|---|---|
| 0024322 | 4/1902 | United Kingdom | 294/19.2 |

OTHER PUBLICATIONS

Publication entitled "Court Equipment, Ballhopper, 1987", pp. 1–4, by Ball Hopper Products.

*Primary Examiner*—James B. Marbert

*Attorney, Agent, or Firm*—Michael R. Swartz; John R. Flanagan

[57] ABSTRACT

A collapsible ball retriever and storage unit is in the form of a receptacle composed of a plurality of side grills pivotally hinged one to the next, and a top gate and a bottom grate being pivotally hinged to respective ones of the side grills. The side grills are pivotable relative to one another to convert them between erected and collapsed positions, whereas the top gate and bottom grate are pivotable relative to the side grills to convert the top gate and bottom grate between closed and retracted opened positions. The gate and grate are latchable to others of the side grills disposed opposite to the ones thereof to which the gate and grate are respectively hinged. The bottom grate is adapted to rigidly retain the side grills in their erected position when the bottom grate is disposed in the closed position. Further, the bottom grate has members defining ball passages therethrough which adapts the receptacle for retrieving and storing balls when the side grills are in the erected position and the bottom grate is in the closed position.

20 Claims, 7 Drawing Sheets

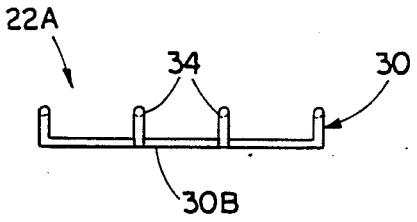
FIG. 9
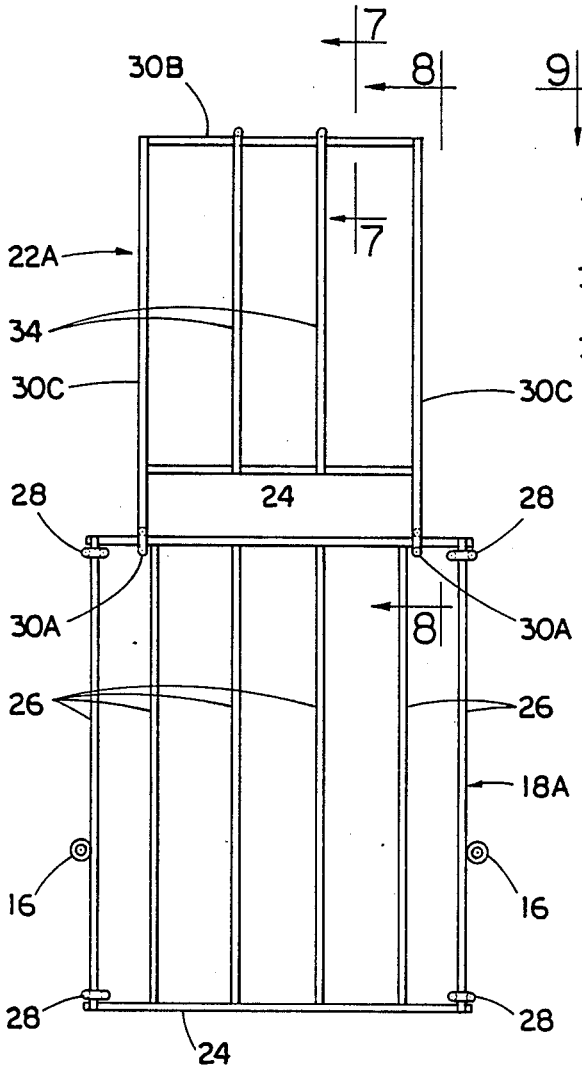
FIG. 6
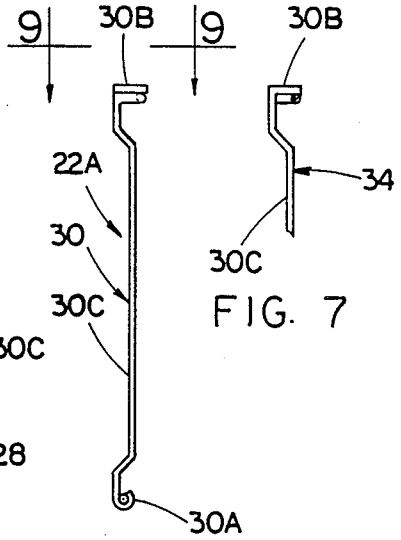
FIG. 8
FIG. 7

COLLAPSIBLE BALL RETRIEVER AND STORAGE UNIT

BACKGROUND OF THE INVENTION

1. Field of the Invention

The present invention generally relates to receptacles for storing articles and, more particularly, is concerned with a ball retriever and storage unit which is collapsible for ease of shipping and storage.

2. Description of the Prior Art

It is conventional in practicing games such as tennis or golf to repetitively hit a large number of balls in order to improve one's skills in different facets of the game. To minimize the time and effort it takes to retrieve and hold the balls, receptacles having wire or rod type frame designs are typically used. Representative of the prior art receptacles of this general design are the ones disclosed in U.S. Pat. Nos. to Minton (704,848), Stap (3,371,950), Seewagen et al (3,820,836), Campbell (3,889,996), Brunner et al (3,984,138), Ouhashi (4,194,779), Verde (4,412,697) and Perez et al (4,461,504), and a British Patent to Hammond et al (24,322).

One highly successful tennis ball retriever and storage unit of this general design, hereinafter referred to as the prior art unit, is marketed by Ball Hopper Products of Pittsburgh, Pa., and illustrated in the Ballhopper court equipment catalog. The prior art unit is a generally square or rectangular receptacle constructed of a plurality of spaced metal wires or small diameter rods (both of which for sake of clarity and convenience are hereinafter referred to as "wire"), affixed such as by spot welding to one another at assembly to form a rigid "box-shaped" structure. The bottom and sides are rigidly connected together, whereas the top is in the form of an openable hinged gate. The wires are spaced apart by an amount less than the diameter of a used tennis ball to retain the stored tennis balls within the receptacle.

The integral rigid bottom of the receptacle forms a grate wherein the wires are also spaced apart slightly less than the diameter of a used tennis ball. The spacing of the grate wires allows easy retrieval of tennis balls from a tennis court and into the receptacle through the spaces between the grate wires. The receptacle is simply placed over balls resting on a tennis court and pushed downward on the court surface. Automatically the balls are squeezed upward between pairs of the bottom grate wires and so forced into the receptacle. Balls already in the receptacle are raised by the incoming balls. All of the retrieved balls are retained in the receptacle until manually poured or removed from the top of the receptacle upon opening of the top hinged gate.

This prior art unit is of economical and simple construction and does not utilize any moving parts for retrieving the balls. It is conveniently and easily usable for retrieving tennis balls and easily manually carried for transporting the retrieved balls to and from a storage area when not in use. At the same time, the top hinged gate of the prior art unit permits ready removal of the balls from storage when desired.

The prior art unit also includes upwardly extending handles removably and pivotally mounted to opposite ends of respective hollow tubes affixed horizontally to the vertical wires of two of the opposite sides of the receptacle. The handle length permits a standing person to raise and lower the receptacle from and against the tennis court playing surface by its handles and thus avoid any substantial bending at the waist. Also, the handles can readily be pivoted 180 degrees relative to the sides of the receptacle from their retrieving position to a supporting position without dismounting them from the receptacle, and thereby transformed into support legs for the receptacle. In the supporting position, the legs dispose the receptacle at a height convenient for easy removal of balls from the receptacle by a tennis player, again without bending at the waist.

However, the rigid, fixed assembly-type receptacle of the prior art unit occupies a volume which is mostly empty space. This causes the packaging, handling, shipping and storage by the supplier to be more costly and cumbersome than it would otherwise be if the box configuration could be rearranged into a more space-efficient form until it arrives at the retailer or the final purchaser's destination. The retailer who often has only limited space available for storage and display of products is handicapped by the relatively large boxes required to pack the receptacles. When not in use and when being transported by the purchaser, the fixed unit is bulky. Basically, the fixed-type nature of the unit increases its vulnerability to damage during both shipment and storage.

Several approaches either can be or have been tried to alleviate some of these problems. One approach to achieving a space-efficient unit would be to provide separate parts representing the sides, top and bottom. This, however, would require the user to properly assemble the various components and thus would reduce its marketability. In another approach used in the prior art unit, space problems of the rigid receptacle have been addressed to a degree by sloping the sides so that the cross section progressively increases from the bottom to the top. This allows the option of nesting several receptacle, typically three, which can then be placed in one package, larger than a single unit package, but somewhat smaller in volume than the sum of three separate single unit packages. Detracting from the limited benefit in space saving, nesting increases the potential for both packing and shipping damage.

Consequently, in view of the disadvantages of the space-saving approaches suggested above, a need still exists for another approach to reducing the space requirements of the prior art retriever and storage unit which will retain its benefits but eliminate its drawbacks.

SUMMARY OF THE INVENTION

The present invention provides a collapsible ball retriever and storage unit designed to satisfy the aforementioned needs. The collapsible unit of the present invention is easy to manufacture, inexpensive, and retains all functional capabilities of the prior art unit while eliminating the disadvantages thereof. It incorporates six pivotally hinged subassemblies, four of which form the side grills and two of which form the top gate and bottom grate. The pairs of opposite side grills are identical in construction as are the top gate and bottom grate. Therefore, there are really only three separate constructions to fabricate in the manufacture of the receptacle.

When the hinged side grills are placed in their erected position and the hinged top gate and bottom grate are pivoted to their closed positions, the receptacle is rigidly erected in it functioning configuration and ready to retrieve and store tennis balls. By merely pivoting the hinged top gate and bottom grate away from their closed positions and moving either of the two pairs of opposite corners formed by the hinged side grills of the receptacle toward each other, the receptacle can be collapsed to an optimum small volume configuration for packaging, shipping or storage. The handles (or legs) are removably mounted as in the prior art unit and are removed from the receptacle prior to packaging.

Accordingly, the present invention is directed to a collapsible ball retriever and storage unit, comprising: (a) a receptacle composed of a plurality of side structures, a top structure and a bottom structure; (b) the side structures being connected one to the next for relative pivotal movement to convert the side structures between erected and collapsed positions; (c) the top and bottom structures being connected to respective ones of the side structures for pivotal movement relative to the side structures between closed and retracted opened positions; (d) either one of the top or bottom structure being adapted to rigidly retain the side structures in the erected position when the one top or bottom structure is disposed in the closed position.

More particularly, the side structures are pivotally hinged one to the next, and the top and bottom structures are pivotally hinged to the respective ones of the side structures. Further, the top and bottom structures are latchable to others of the side structures disposed opposite to the ones thereof to which the top and bottom structures are respectively hinged. Also, the side structures are pivotable to the collapsed position in which the hinged side structures in two pairs thereof are folded adjacent to one another once the top and bottom structures have been pivoted away from the closed positions. Pivoting of the side structures to the collapsed position reduces the receptacle to a smaller volume by moving either one of two pairs of opposite corners formed by the hinged side structures toward each other.

The bottom structure of the collapsible unit also has means defining ball passages therethrough which adapts the receptacle for retrieving and storing balls when the side structures are in the erected position and the bottom structure is in the closed position. Furthermore, the top and bottom structures each have elongated middle portions which are offset from opposite end portions thereof such that the top and bottom structures will extend generally parallel along the respective ones of the side structures when pivoted to the retracted opened positions.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which:

FIG. 6 is an end elevational view of the collapsible unit as seen along line 6—6 of FIG. 5.

FIG. 7 is a fragmentary side elevational view, partly in section, of the top gate of the collapsible unit as seen along line 7—7 of FIG. 6.

FIG. 8 is a side elevational view of the top gate of the collapsible unit as seen along line 8—8 of FIG. 6 with the gate removed from the unit.

FIG. 9 is an end view of the top gate as seen along line 9—9 of FIG. 8.

DETAILED DESCRIPTION OF THE INVENTION

Figure 1:
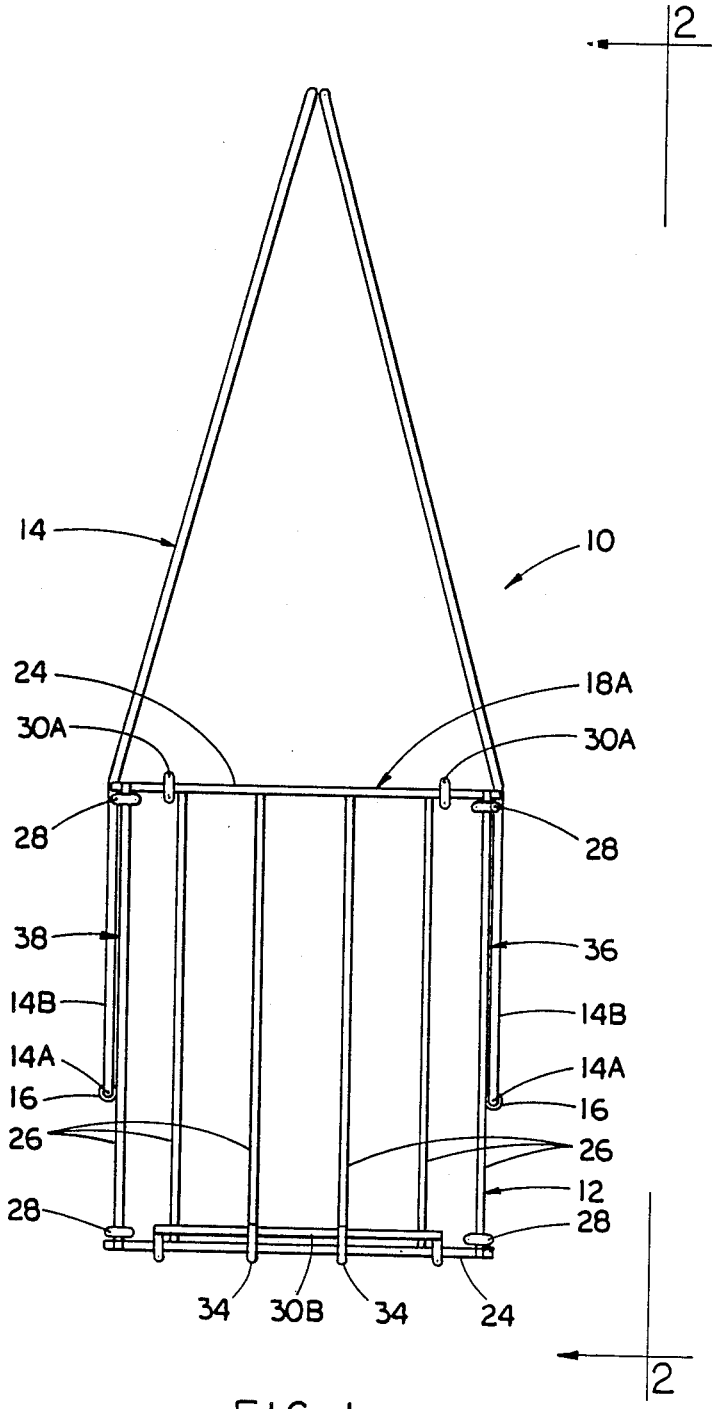
FIG. 1 is an end elevational view of the collapsible ball retriever and storage unit of the present invention with the extension members of the unit in carrying position.
Figure 2:
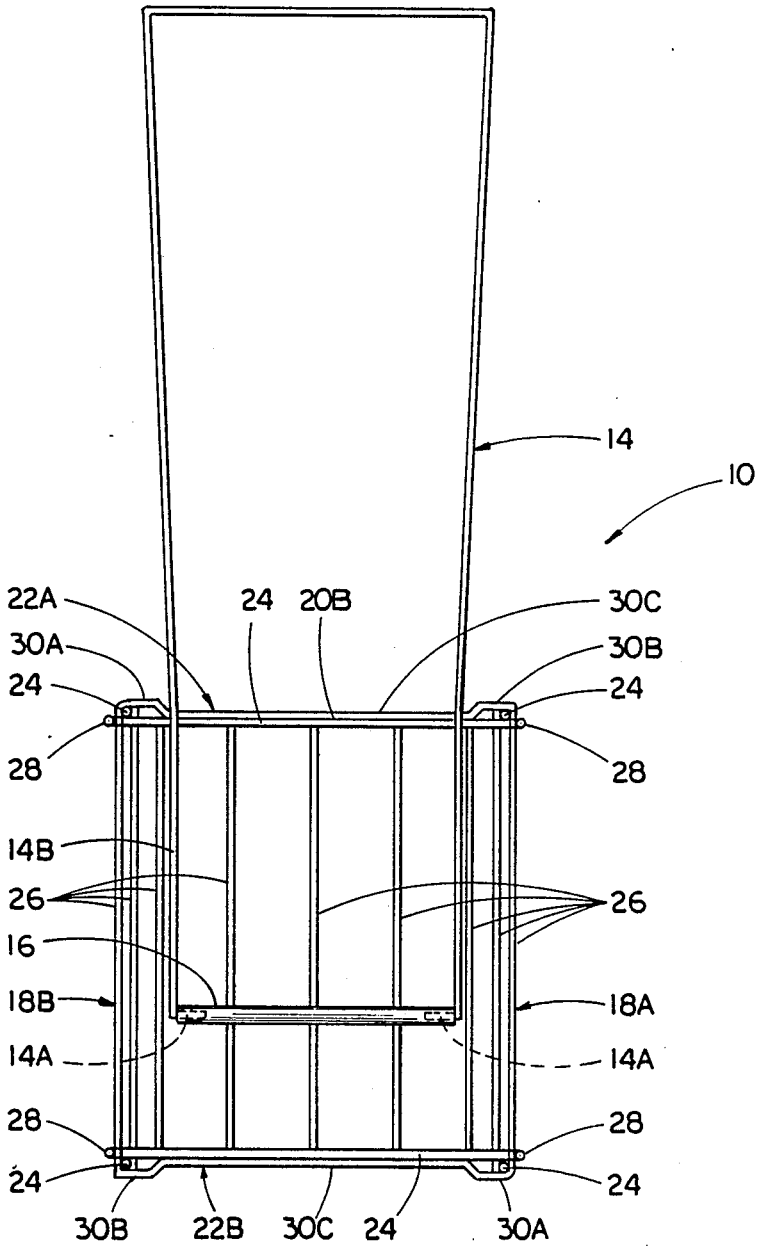
FIG. 2 is a side elevational view of the collapsible unit as seen along line 2—2 of FIG. 1.
Figure 3:
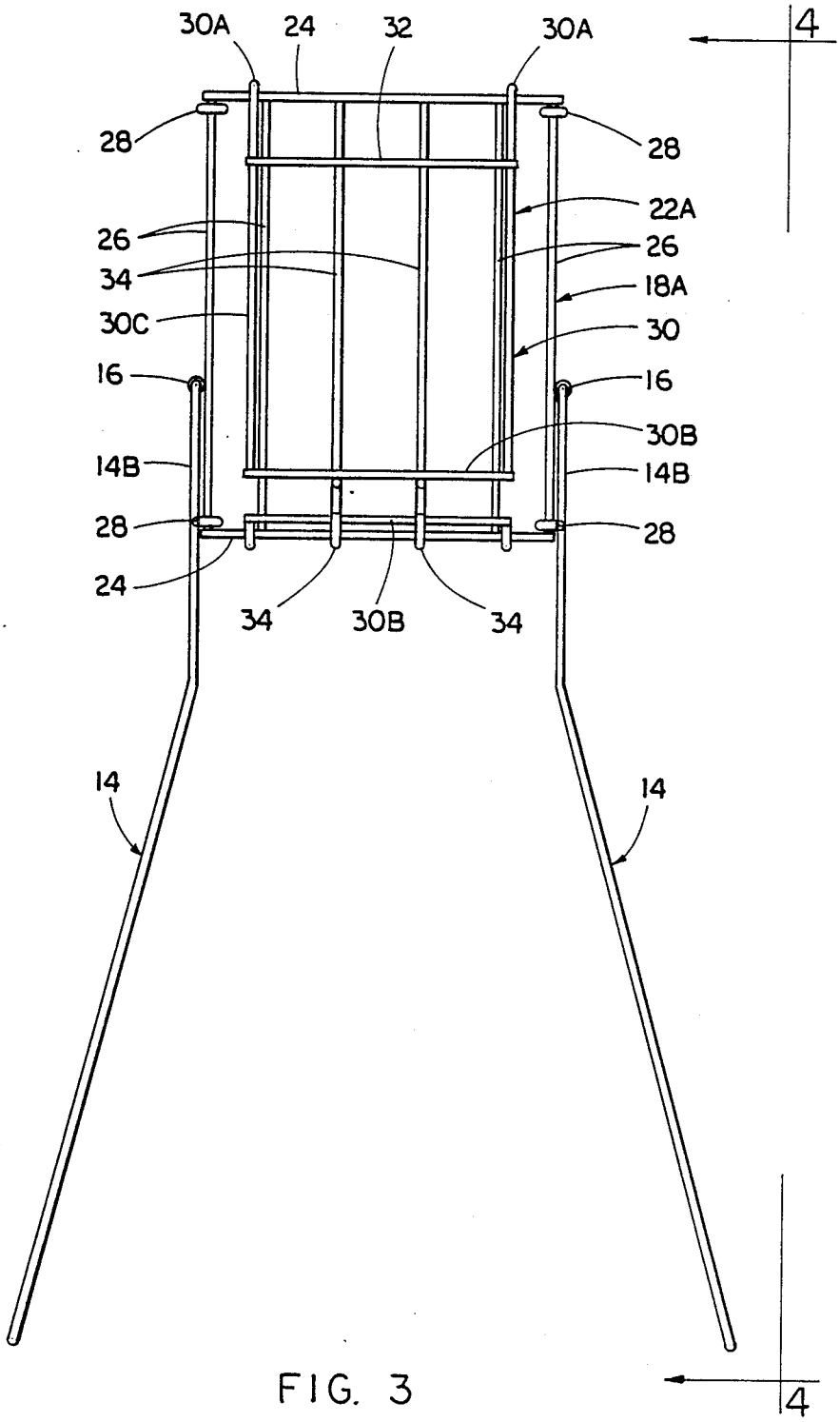
FIG. 3 is an end elevational view of the collapsible unit similar to FIG. 1, but with the extension members of the unit in supporting position.
Figure 4:
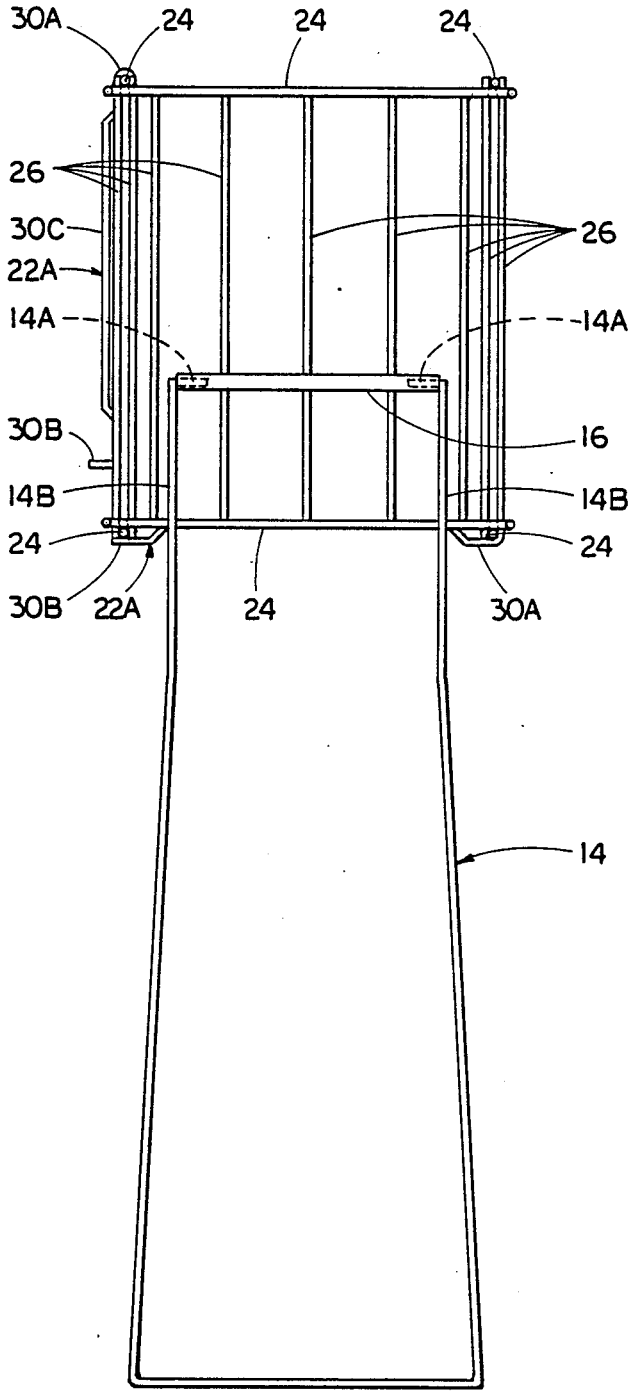
FIG. 4 is a side elevational view of the collapsible unit as seen along line 4—4 of FIG. 3.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIGS. 1 to 4, there is shown a collapsible ball retriever and storage unit, generally indicated by the numeral 10 and constructed in accordance with the principles of the present invention. The collapsible unit is particularly suited for retrieving and storing tennis balls in much the same manner as done by the standard unit heretofore. However, the principles of the present invention can be applied to other storage units having the general construction of the unit 10 which are adapted for storing other articles or for retrieving other types of balls.

In its basic parts, the collapsible unit 10 includes a receptacle assembly 12 and a pair of extension members 14 pivotally mounted to the receptacle assembly 12. The extension members 14 can be pivoted between the one orientation seen in FIGS. 1 and 2 wherein they are used as a handle and an opposite or reverse orientation seen in FIGS. 3 and 4 approximately 180 degrees from the one orientation wherein they are used as a stand. The extension members 14, their configurations and reversible orientations, and their removable mounting relation to opposite ends of respective hollow tubes 16 affixed to opposite sides of the receptacle assembly 12 are substantially identical to the extension members employed by the prior art unit and so form no part of the present invention. They are mentioned herein merely to point out that the collapsible unit 10 also retains the benefits they provided in the prior art unit.

The receptacle assembly 12 of the collapsible unit 10 is the part thereof which embodies the features of the present invention. In particular, the receptacle assembly 12 is composed of a plurality of subassemblies 18A,18B,-20A,20B,22A,22B. Four of the subassemblies 18A,18B,-20A,20B are pivotally hinged together to form side structures, or grills, of the receptacle assembly 12, whereas the remaining two of the subassemblies 22A,22B form top and bottom structures, or a top gate and bottom grate, pivotally hinged to one pair of the side subassemblies 18A,18B. So as to minimize the number of different designs which have to be fabricated and assembled together to complete the receptacle assembly 12, preferably, the pairs of opposite subassemblies 18A,18B and 20A,20B forming the side structures are identical in construction as are the subassemblies 22A,22B forming the top and bottom structures.

More particularly, the hinged side, top and bottom structures 18A,18B,20A,20B,22A,22B are constructed of metallic wire or small diameter rod, preferably, on the order of $\frac{1}{8}$ to $\frac{3}{8}$ inch diameter. (Hereafter, in the description of the construction of the side, top and bottom structures, the word "wire" is used with a broad meaning such as is commonly given to the word "member".) Both pairs of opposite subassemblies forming the side structures 18A,18B and 20A,20B include upper and lower horizontally placed wires 24 and a plurality, typically four to six in number, of vertically placed wires 26 approximately equally spaced from one another and affixed such as by spot welding at each end to the horizontal wires 24. The spacing of the vertical wires 26 is less than the diameter of a ball, such as a tennis ball, stored within the receptacle assembly 12. The length of the vertical wires 26 sets the height of the receptacle assembly 12 and together with the length of each horizontal wire 24 establishes the ball capacity of the receptacle assembly.

Figure 11:
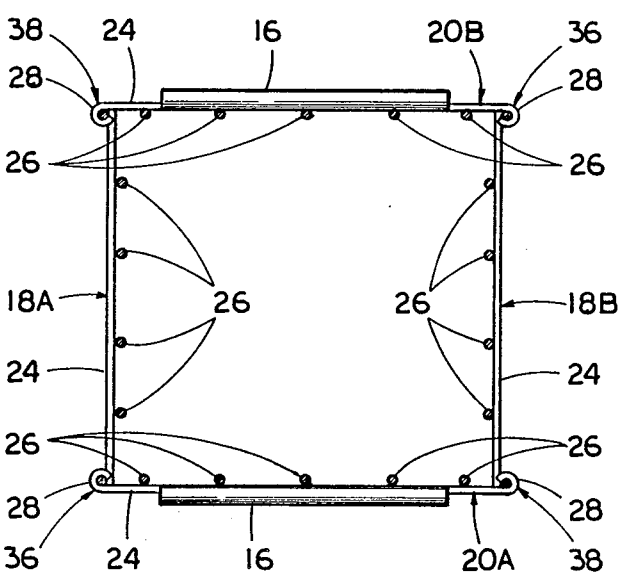
FIG. 11 is a sectional view similar to that of FIG. 10, but with the bottom grate being removed to illustrate the erected position of the hinged side grills of the unit.
Figure 12:
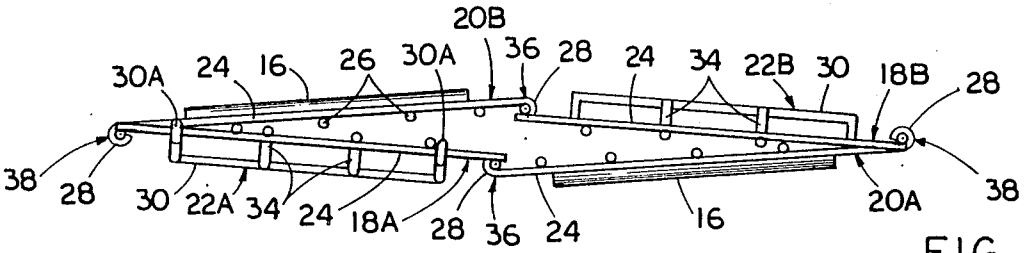
FIG. 12 is a top plan view of the collapsible unit of FIG. 5, but showing the unit in its collapsed position for packaging, shipping and storing.

By being hinged one to the next, the side structures 18A,18B,20A,20B of the receptacle assembly 12 are pivotable relative to one another to convert the side structures and thereby the receptacle assembly 12 between erected and collapsed positions, as illustrated respectively in FIGS. 11 and 12. Each opposite end 28 of both the upper and lower horizontal wires 24 on the side structures 20A,20B of the other pair thereof is formed into a hook shape which encircles each adjacent vertical end wire 26 of the side structures 18A,18B of the one pair thereof to provide the respective hinged connections.

Figure 10:
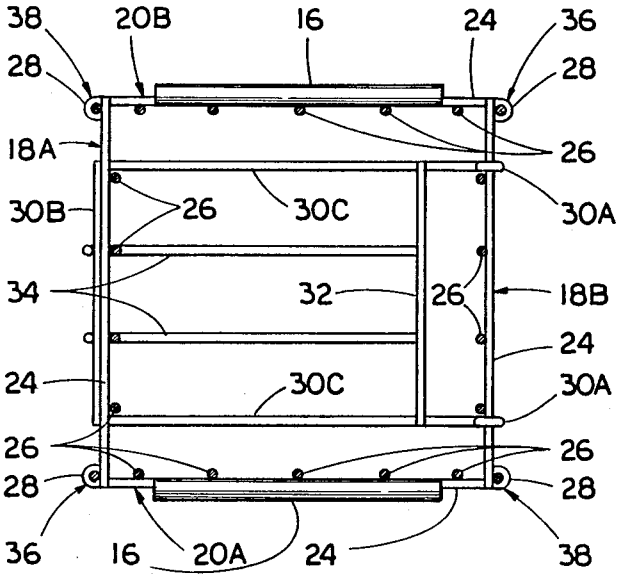
FIG. 10 is a sectional view of the collapsible unit taken along line 10—10 in FIG. 5, showing the bottom grate in closed position.

Referring to FIGS. 5 to 10, both subassemblies 22A,22B of the receptacle assembly 12 forming the top and bottom structures are composed of a plurality of intersecting wires connected together such as by spot welding, with the spacing between them being less than the diameter of a tennis ball stored in the receptacle assembly 12. More particularly, the top and bottom structures 22A,22B each includes an outer perimeter wire 30 bent into a U-shaped configuration with its two ends 30A formed into hooks which encircle respective diagonally opposite upper and lower horizontal wires 24 of the side structures 18A,18B. As best seen in FIG. 6, the hooked ends 30A of the U-shaped outer wire 30 of the top structure or gate 22A hingedly connects to the top horizontal wire 24 of the one side structure or grill 18A, whereas, as best seen in FIG. 10, the hooked ends 30A of the U-shaped outer wire 30 of the bottom structure or grate 22B hingedly connects to the bottom horizontal wire 24 of the other side structure or grill 18B. The opposite end 30B of each U-shaped outer wire 30 is bent downward (in the z-plane) in such manner as to create a latch-, snap- or clasp-type engagement with the other diagonally opposite upper and lower horizontal wires 24 of the side structures 18A,18B.

The top and bottom structures 22A,22B also each includes a cross wire 32 extending between and affixed at its opposite ends to the respective U-shaped outer wire 30 at locations spaced from the hooked ends 30A thereof and several spaced longitudinal wires, preferably two in number, extending between and affixed at their opposite ends to the opposite end 30B of the U-shaped outer wire 30 and to the cross wire 32.

Figure 5:
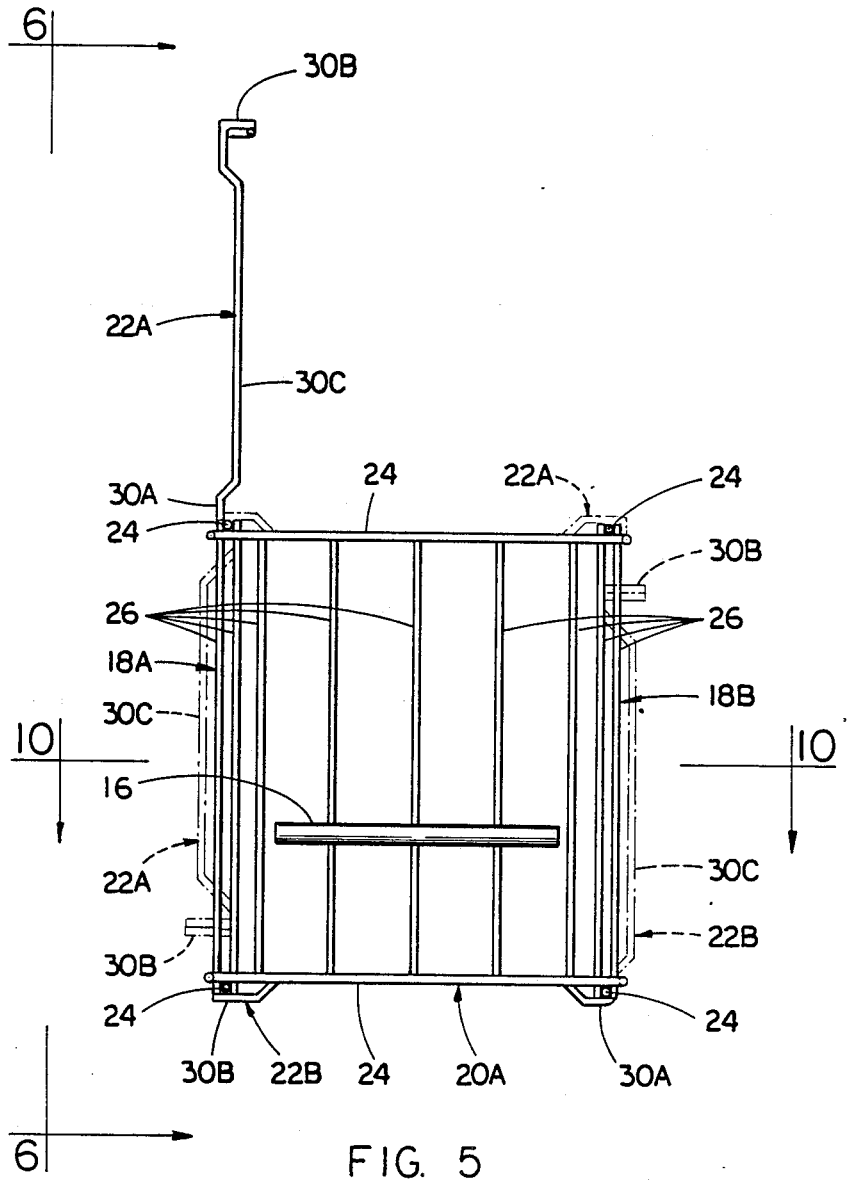
FIG. 5 is a side elevational view of the collapsible unit similar to FIG. 4, but with the extension members removed and showing the top gate both in closed position and in retracted position for shipping, in dashed line form, and in opened position, in solid line form, and the bottom grate in retracted position for shipping in dashed line form and in horizontal closed position in solid line form.

By being hinged to the respective side structures 18A,18B of the other pair thereof, the top and bottom structures 22A,22B are pivotable relative thereto to convert between closed and retracted opened positions. In FIG. 5, the top structure or gate 22A is illustrated in dashed line form both in its horizontal closed position for ball storing and in its retracted opened position for shipping and is illustrated in solid line form in its upright opened position for ball removal. The bottom structure or grate 22B is illustrated in dashed line form in retracted opened position for shipping and in horizontal closed position for ball retrieving and storing. Also as best seen in FIGS. 5 and 8, the longitudinal middle portions 30C of the outer U-shaped wire 30 of the top and bottom structures 22A,22B are offset, for example preferably approximately $\frac{1}{4}$ inch, from the opposite ends 30A,30B thereof. The offset allows the top and bottom structures (gate and grate) 22A,22B to extend generally parallel or flat along the respective ones of the side structures 18A,18B when pivoted to the retracted opened positions and thereby make it possible to obtain the minimum volume of the collapsed receptacle assembly 12. The longitudinal wires 34 are also conformed to the offset shape of that of the outer U-shaped wire 30.

When one or both of the top and bottom structures 22A,22B are snapped or latched at their closed horizontal positions, they rigidly retain the side structures 18A,18B,20A,20B in their erected position. Thus, with the bottom structure 22B closed, the top structure 22A can be pivoted open to remove balls from within the receptacle assembly 12 without affecting the stability of the erected receptacle assembly. Furthermore, the spacing of the wires composing the bottom structure or grate 22B defines ball passages slightly narrower than the diameter of a tennis ball which adapts the receptacle 12 for retrieving and storing balls when the side structures or grills 18A,18B,20A,20B are in the erected position and the bottom structure 22B is in the closed position. To convert the receptacle assembly 12 from the erected position of FIG. 11 to the collapsed position of FIG. 12, the top and bottom structures 22A,22B are first unlatched and pivoted to their retracted opened positions in which they are folded back adjacent to and along the exteriors of the side structures 18A,18B. Then, the side structures 18A,18B,20A,20B are pivoted to the collapsed position in which adjacent pairs thereof are folded adjacent to one another at their respective interiors and the receptacle assembly 12 is thereby reduced to a much smaller volume, being optimum for packaging, shipping or storing. Specifically, the side structures 18A,18B,20A,20B are collapsed by moving either one of two pairs of opposite corners 36,38 formed by the hinged side structures toward each other once said top and bottom structures have been pivoted away from said closed positions.

The hollow tubes 16 which removably mount the extension members 14 are permanently attached to the side structures 20A,20B of the receptacle assembly 12. The extension members 14 have inturned ends 14A which insert into and seat in the opposite ends of the tubes 16. By pulling in opposite directions of the legs 14B of the extension members 14, they can be dismounted from the tubes 16. The extension members 14 are removed from the receptacle assembly 12 prior to collapsing thereof for packaging or storage.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. A collapsible ball retriever and storage unit, comprising:

(a) a receptacle composed of a plurality of side structures and a bottom structure;

(b) said side structures being connected one to the next for relative pivotal movement to convert said side structures between erected and collapsed positions;

(c) said bottom structure being connected to at least one of said side structures for pivotal movement relative to said side structures between closed and retracted opened positions;

(d) said bottom structure being adapted to rigidly retain said side structures in said erected position when said bottom structure is disposed in said closed position.

2. The collapsible unit as recited in claim 1, wherein said side structures are pivotally hinged one to the next.

3. The collapsible unit as recited in claim 1, wherein said bottom structure is pivotally hinged to one of said side structures.

4. The collapsible unit as recited in claim 1, wherein said bottom structure has means defining ball passages therethrough which adapts said receptacle for retrieving and storing balls when said side structures are in said erected position and said bottom structure is in said closed position.

5. A collapsible ball retriever and storage unit, comprising:

(a) a receptacle composed of a plurality of side structures, a top structure and a bottom structure;

(b) said side structures being connected one to the next for relative pivotal movement to convert said side structures between erected and collapsed positions;

(c) said top and bottom structures being connected to respective ones of said side structures for pivotal movement relative to said side structures between closed and retracted opened positions;

(d) either one of said top or bottom structure being adapted to rigidly retain said side structures in said erected position when said one top or bottom structure is disposed in said closed position.

6. The collapsible unit as recited in claim 5, wherein said side structures are pivotally hinged one to the next.

7. The collapsible unit as recited in claim 5, wherein said top and bottom structures are pivotally hinged to said respective ones of said side structures.

8. The collapsible unit as recited in claim 7, wherein said top and bottom structures are latchable to others of said side structures disposed opposite to said ones thereof to which said top and bottom structures are respectively hinged.

9. The collapsible unit as recited in claim 5, wherein said bottom structure has means defining ball passages therethrough which adapts said receptacle for retrieving and storing balls when said side structures are in said erected position and said bottom structure is in said closed position.

10. The collapsible unit as recited in claim 5, wherein said side structures are pivotally hinged one to the next and said top and bottom structures are pivotally hinged to said respective ones of said side structures such that said side structures are pivotable to said collapsed position in which said hinged side structures in two pairs thereof are folded adjacent to one another once said top and bottom structures have been pivoted away from said closed positions.

11. The collapsible unit as recited in claim 5, wherein said side structures are pivotally hinged one to the next and said top and bottom structures are pivotally hinged to said respective ones of said side structures such that said side structures are pivotable to said collapsed position to reduce said receptacle to a smaller volume by moving either one of two pairs of opposite corners formed by said hinged side structures toward each other.

12. The collapsible unit as recited in claim 5, wherein said top and bottom structures each have opposite end portions and elongated middle portions which are offset from said opposite end portions thereof such that said top and bottom structures will extend generally parallel along said respective ones of said side structures when pivoted to said retracted opened positions.

13. A collapsible ball retriever and storage unit, comprising:

(a) a receptacle composed of a plurality of side grills pivotally hinged one to the next, and a top gate and a bottom grate being pivotally hinged to respective ones of said side grills;

(b) said side grills being pivotable relative to one another to convert said side grills between erected and collapsed positions;

(c) said top gate and bottom grate being pivotable relative to said side grills to convert said top gate and bottom grate between closed and retracted opened positions;

(d) said bottom grate being adapted to rigidly retain said side grills in their erected position when said bottom grate is disposed in said closed position.

14. The collapsible unit as recited in claim 13, wherein said gate and grate are latchable to others of said side grills disposed opposite to said ones thereof to which said gate and grate are respectively hinged.

15. The collapsible unit as recited in claim 13, wherein said bottom grate has means defining ball passages therethrough which adapts said receptacle for retrieving and storing balls when said side grills are in said erected position and said bottom grate is in said closed position.

16. A collapsible ball retriever and storage unit, comprising:

(a) a receptacle assembly composed of a plurality of subassemblies, four of which are hinged together to form side structures of said receptacle assembly and two of which form a top structure and a bottom structure thereof;

(b) said hinged side structures being pivotable relative to one another to convert said side structures between erected and collapsed positions;

(c) said top and bottom structures being hinged to respective ones of said side structures and pivotable relative thereto to convert said top and bottom structures between closed and retracted opened positions;

(d) said bottom structure being adapted to rigidly retain said side structures in said erected position when said one bottom structure is disposed in said closed position;

(e) said side structures being pivotable to said collapsed position in which hinged side structures in two pairs thereof are folded adjacent to one another and said receptacle is thereby reduced to a smaller volume by moving either one of two pairs of opposite corners formed by said hinged side structures toward each other once said top and bottom structures have been pivoted away from said closed positions.

17. The collapsible unit as recited in claim 16, wherein said top and bottom structures are latchable to others of said side structures disposed opposite to said ones thereof to which said top and bottom structures are respectively hinged.

18. The collapsible unit as recited in claim 16, wherein said bottom structure has means defining ball passages therethrough which adapts said receptacle for retrieving and storing balls when said side structures are in said erected position and said bottom structure is in said closed position.

19. The collapsible unit as recited in claim 16, wherein pair of opposite ones of said side structures are identical in construction.

20. The collapsible unit as recited in claim 16, wherein said top and bottom structures are identical in construction.

* * * * *